US008192155B2

(12) United States Patent
Andrews

(10) Patent No.: US 8,192,155 B2
(45) Date of Patent: Jun. 5, 2012

(54) MULTISTAGE SLURRY PUMP

(75) Inventor: Dale B Andrews, Derry, NH (US)

(73) Assignee: Flowserve Management Company, Irving, TX (US)

( * ) Notice: Subject to any disclaimer, the term of this patent is extended or adjusted under 35 U.S.C. 154(b) by 1078 days.

(21) Appl. No.: 12/107,822

(22) Filed: Apr. 23, 2008

(65) Prior Publication Data

US 2008/0267773 A1 Oct. 30, 2008

Related U.S. Application Data

(60) Provisional application No. 60/913,585, filed on Apr. 24, 2007.

(51) Int. Cl.
*F04D 29/54* (2006.01)

(52) U.S. Cl. ..... 415/196; 415/206; 415/199.1; 417/900

(58) Field of Classification Search ..... 415/196, 415/197, 199.1, 200, 206, 211.2; 417/900
See application file for complete search history.

(56) References Cited

U.S. PATENT DOCUMENTS

| | | | | |
|---|---|---|---|---|
| 2,422,412 | A * | 6/1947 | Van Der Merwe Haarhoff | 427/236 |
| 4,307,995 | A * | 12/1981 | Catterfeld | 415/199.1 |
| 4,781,531 | A * | 11/1988 | James | 415/199.1 |
| 5,752,803 | A * | 5/1998 | Wetzel et al. | 415/182.1 |
| 6,379,127 | B1 | 4/2002 | Andrews et al. | |
| 6,439,835 | B1 * | 8/2002 | Chien et al. | 415/104 |
| 6,893,219 | B2 | 5/2005 | Conti | |
| 7,239,056 | B1 | 7/2007 | Griggs et al. | |
| 7,341,436 | B2 | 3/2008 | Andrews | |

* cited by examiner

*Primary Examiner* — Edward Look
*Assistant Examiner* — Andrew C Knopp
(74) *Attorney, Agent, or Firm* — Maine Cernota & Rardin

(57) ABSTRACT

A multistage, centrifugal partial emissions pump with a first stage impeller, a final stage impeller, a first stage casing liner, one or more first stage discharge nozzles, a final stage casing liner, one or more final stage discharge nozzles, an interstage delivery channel liner, one or more delivery channels, and an outer pressure shell wherein the first stage casing liner and the final stage casing liner are connected by one or more fluid channels integral within a delivery channel liner, that follow an arced path directed predominantly radially inward within the interstage delivery channel liner, and the sum of the cross sectional areas of all delivery channels taken on a radial plane intersecting the delivery channels is less than the sum of cross sectional areas of the non-channel areas within the boundaries of the channels.

8 Claims, 5 Drawing Sheets

MULTISTAGE SLURRY PUMP

RELATED APPLICATIONS

This application claims the benefit of U.S. Provisional Application No. 60/913,585, filed Apr. 24, 2007 and is herein incorporated in its entirety by reference.

BACKGROUND OF THE INVENTION

Centrifugal pumps are used handle a wide variety of fluids under a broad range of operational conditions. Centrifugal pumps that are capable of handing abrasive slurries at low flow rates while developing high total dynamic heads are desired for many industrial processes.

One type of pump that is used to deliver low flow at high heads is called a Partial Emissions (PE) Pump. The name partial emissions comes from a feature whereby flow from the impeller chamber is controlled by a discharge nozzle such that only a small percentage of the total casing volume leaves the pump in any single impeller revolution. This maintains a high process fluid rotational velocity vector and a small radial velocity vector. The high rotational velocity vector is what gives the partial emission pump a higher head coefficient than seen for a traditional centrifugal pump stage.

To meet higher application head, designers must increase the impeller tip speed or increase the number of stages. Both methods have been employed for clean liquid applications, but existing designs pose reliability and safety problems when handling erosive fluids. The high fluid relative velocities and relatively small passages of low Ns pumps result in erosive wear to pressure containing parts. This wear is exacerbated in non-linear fluid passages where additional energy is transferred to the fluid passage when the fluid is forced to change direction.

Two-stage PE pumps have been described wherein two coaxial impellers reside in separate chambers defined in part by an interstage body separating the two stages. Fluid flows between the first stage and the second stage, at a relatively high velocity, within an annular duct arranged in a series of turns within the main pump body such that fluid leaving the first stage impeller is turned through more than 180 degrees to position it for entry to the second stage impeller. Because the fluid ducts between the stages are, for the most part integral with the pressure containing components, any erosive wear will tend to decrease the pressure retaining capability of the pressure containing components.

One accepted practice for handling abrasive laden fluids at high velocities is to use wear liners that isolate the pressure containing components of the pump from the high velocity fluid, designed such that all of the high fluid velocity areas of the pump are encompassed by the internal liners. Wear occurs on the liner surfaces and not on the surfaces of the pressure retaining components. Lined pumps have been designed for both single and multistage applications. However, existing designs are of the conventional centrifugal pump design wherein design flow for a given impeller diameter and rotative speed is controlled by the first stage impeller design. This allows designers to utilize circumferential diffusers, guide vanes, return channels and the like, to channel flow from one stage to the next. These designs would be unsuitable for a PE pump, where the low flow rates would result in efficiency losses due to excess interstage diffusion.

Therefore it would be of use to have a multistage slurry pump of a partial emissions design where the pressure retaining parts are protected from erosive wear by liners within the pressure containing components of the pump, designed such that all of the high fluid velocity areas of the pump are encompassed by the liners. It would also be desirable to retain the partial emission design features and benefits in managing flow from the discharge of one stage to the inlet of the next.

SUMMARY OF THE INVENTION

According to one aspect of the present invention there is a pump comprising an outer pressure retaining shell, an actuating shaft on which a plurality of impellers are coaxially mounted, a first stage impeller housed within a front chamber made up of a inlet liner and a casing liner. The pump inlet liner communicates with the pump inlet, the pump casing liner discharge communicates to second and subsequent stage impeller(s) through one or more equally spaced tangential outlets to an interstage section, each with a nozzle discharging to a straight conical diffuser and downstream return channel formed by the coaxial assembly of the casing liner and the inlet liner of the subsequent stage. One of the liners has a machined or cast channel for conveyance of the fluid that follows an arced path predominantly radially inward within the assembly of adjacent casing liners, with the sum of cross sectional areas of all delivery channel(s) taken on a radial plane intersecting the delivery channels being less than the sum of the cross sectional areas of the non-channel areas within the boundaries of the channels on the radial plane. The interstage section terminus is at the inlet of a subsequent stage impeller housed within a chamber comprising an inlet liner and a casing liner, the design repeating itself until the last stage wherein the tangential discharge of the casing liner communicates through one or more straight conical diffusers housed by a discharge nozzle liner that may be separate or an integral part of the final stage casing. Each assembly communicates fluid to the void between the pressure retaining casing and the internal liners such that the casing becomes hydrostatically pressurized.

Further details may be obtained from the following description of other aspects and embodiments of the invention, which for convenience describes a two stage pump with dual outlets in each stage except the final stage. Other embodiments not shown could include additional stages and/or a different number of outlets in each stage without detracting from the claimed invention.

DETAILED DESCRIPTION

Figure 1:
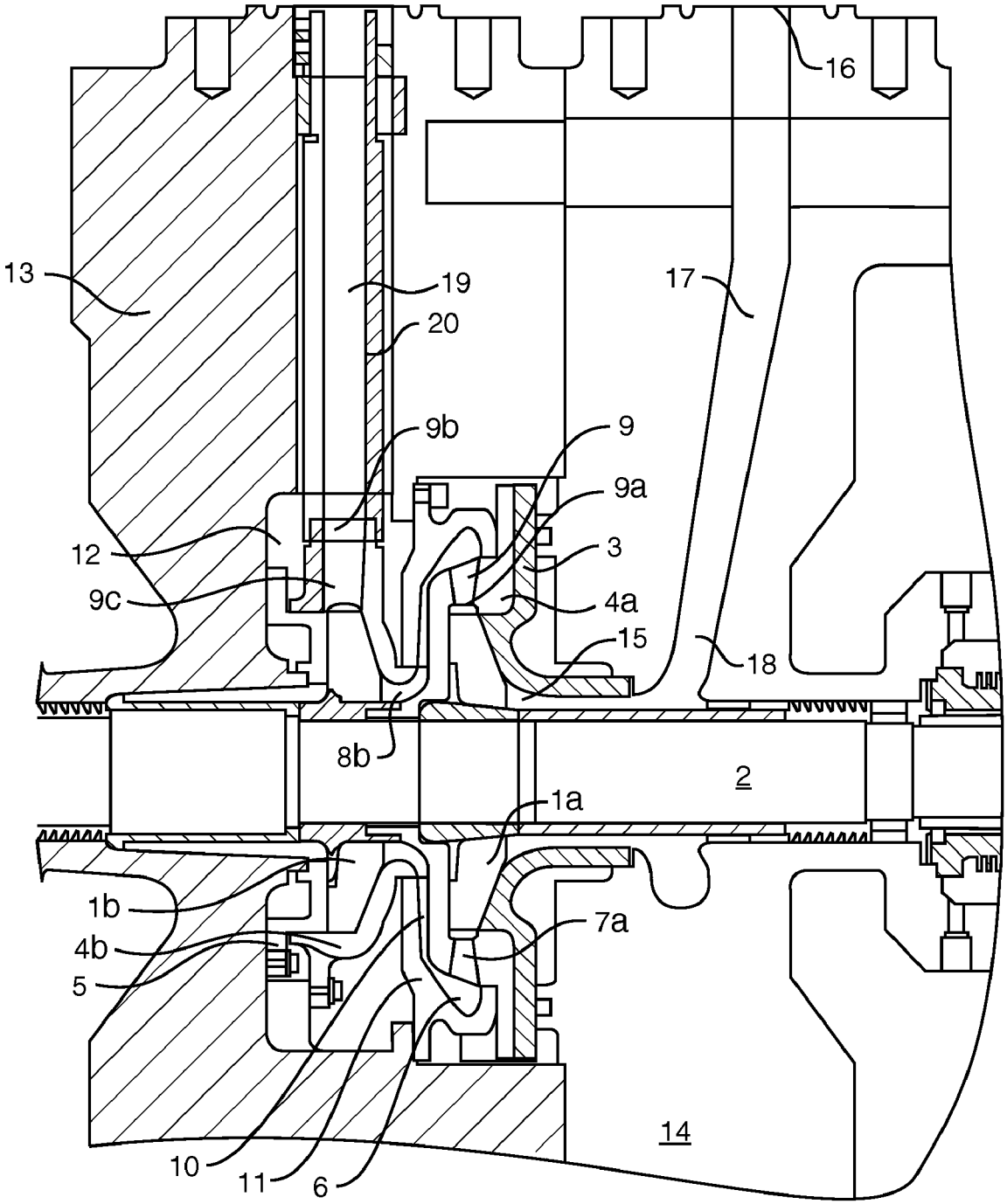
FIG. 1 shows a partial sectional view of one embodiment of a pump according to the present invention, where different styles of shading or no shading are used soley to differentiate the structural elements.

The invention is susceptible of many embodiments; what is shown and described here is illustrative but not exhaustive of the scope of the invention. As shown in FIG. 1, the pump according to one embodiment of the present invention comprises a plurality of impellers 1, here illustrated as 1A and 1B, coaxially aligned on shaft 2 that is rotatably supported by bearings (not shown).

Figure 2:
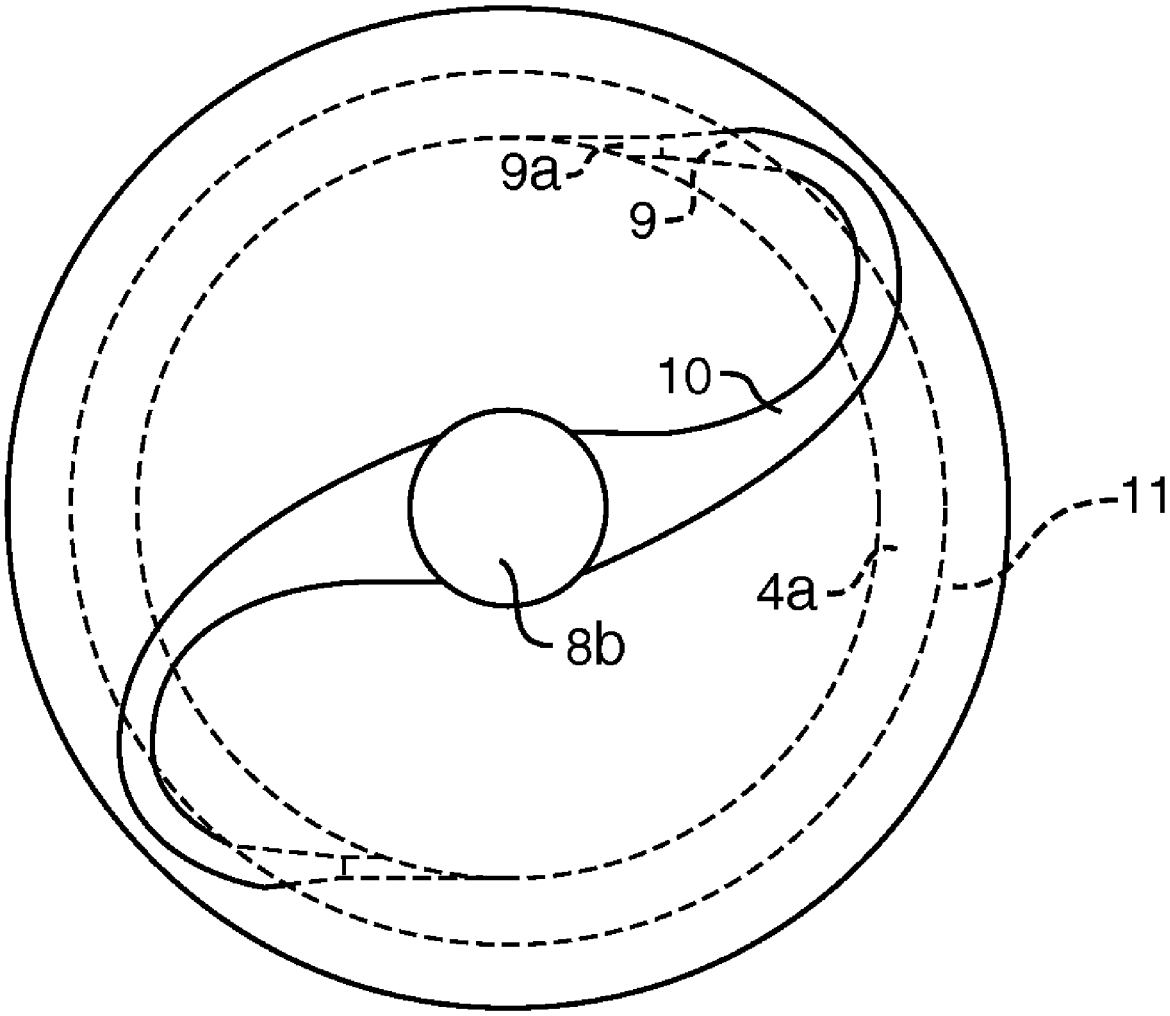
FIG. 2 shows a diagrammatic end view of the first stage casing liner and channel liner.

Referring to the figures and FIGS. 1 and 2 in particular, in one embodiment there is a first stage impeller 1A and a final stage impeller 1B. First stage impeller 1A is housed within a chamber formed by the assembly of suction liner 3 and casing liner 4A. Final stage impeller 1B is housed in a chamber formed by casing liner 4B and cover 5. Casing liners 4A and 4B are interconnected by one or more fluid channels 6 extending from the outlet 7A of casing liner 4A to the annular inlet 8B of casing liner 4B. Each fluid channel 6 consists of a conical diffuser 9, attached to nozzle 9A and arranged tangentially to the inside diameter of casing liner 4A, a delivery channel 10 connecting the outlet of conical diffuser 9 to annular inlet 8B by following an arced path directed predominantly radially inward between casing liner 4A and channel liner 11. The cross sectional area of channel 10, taken on an intersecting radial plane, is controlled so as to control head loss between stages and provide a smooth inlet flow pattern to the subsequent stage. The particular design of channel 10 will vary with the flow requirements of each pump or embodiment of the invention, but the sum of the cross sectional areas of all delivery channel(s) 10 will be less than the sum of cross sectional areas of the non-channel areas within the boundaries of the channels on the plane. The configuration of casing liner 4A and channel liner 11 can optionally be repeated until a final stage. For the purposes of this embodiment a two stage configuration is described. However additional stages could be utilized in this or other embodiments without taking away from the claimed invention.

Figure 3:
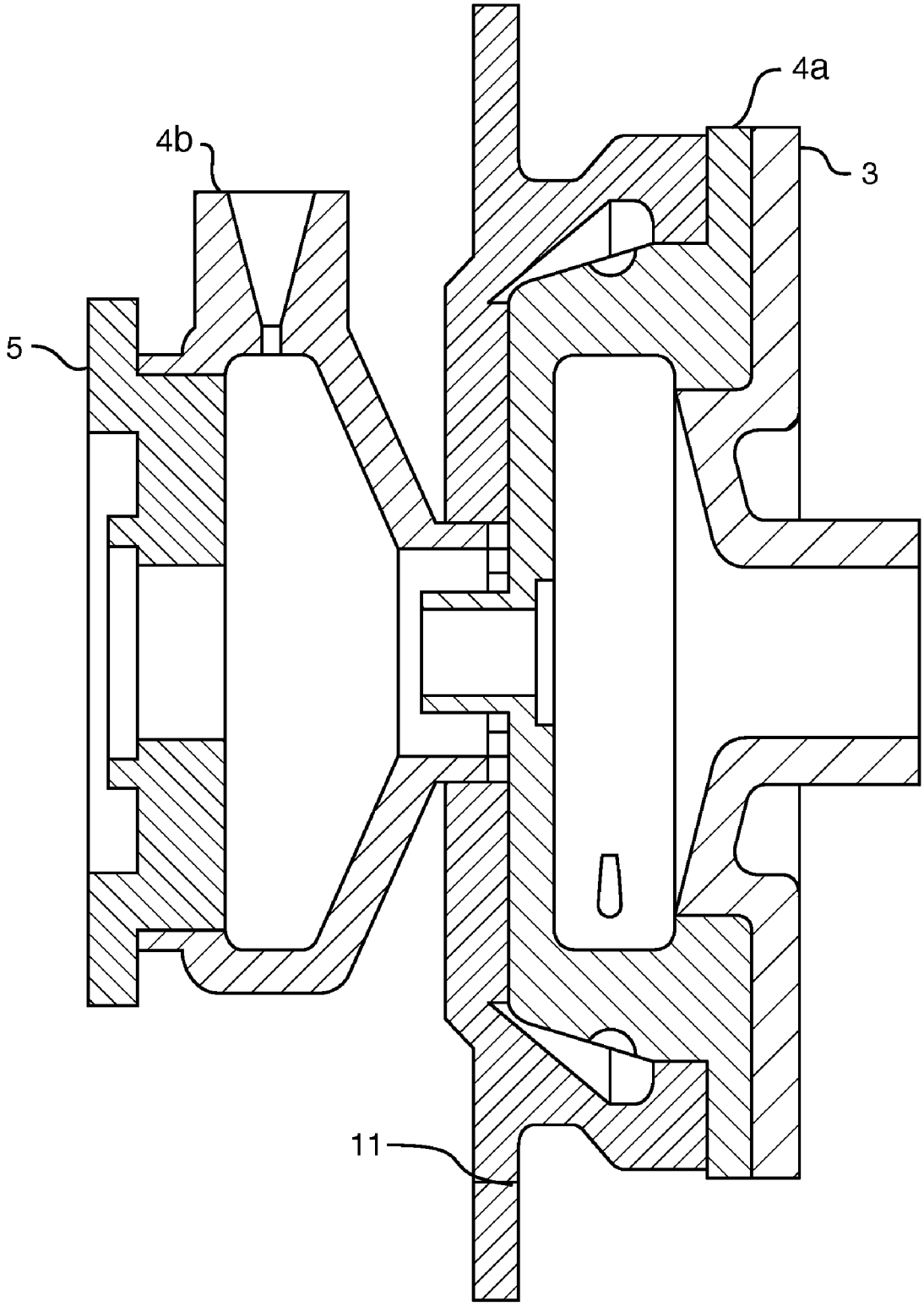
FIG. 3 is a partial section view of the embodiment of FIG. 1, illustrating selected structural elements, where different styles of shading or no shading are used soley to differentiate the structural elements.

Referring to the figures including FIG. 3 in particular, casing liner 4A, channel liner 11, casing liner 4B, and liner cover 5 are all rigidly mounted within an annular chamber 12 in outer pressure shell 13 of FIG. 1. Suction liner 3 is rigidly attached to pressure shell cover 14. The assembly of outer pressure shell cover 14 to outer pressure shell 13 positions suction liner 3 relative to casing liner 4A to form a chamber for the operation of the first stage impeller.

Leakage along the shaft to atmosphere is prevented by mechanical seals (not shown) mounted outboard of outer pressure shells 13 and 14. The first stage impeller inlet 15 communicates with fluid inlet piping suitably attached to inlet connection 16 on outer pressure shell cover 14, via passage 17 that communicates with annular suction liner inlet 18.

The discharge from the final stage casing 4B communicates with piping suitably mounted on outer pressure shell 13, via passage 19 of discharge liner 20 which extends from the outlet of nozzle 9B of conical diffuser 9C though passage 19. In another embodiment, not shown, final stage casing 4B may employ a plurality of tangential outlets, each with a nozzle 9B and conical diffuser 9C communicating with passage 19 via a delivery channel 10, traveling in a predominately arced direction from the outlet of conical diffuser 9 to the inlet of passage 19.

Casing liner 4A, 4B, channel liner 11, and discharge liner 20 are assembled with close fitting surfaces that are not sealed so as to allow fluid to communicate with annular chamber 12.

In operation, abrasive laden fluid, herein known as the process fluid, enters the pump at inlet connection 16 on outer pressure shell cover 14 and travels though passage 17 and annular suction liner inlet 18 to impeller inlet 15 of the first stage impeller 1A within the chamber formed by the assembly of suction liner 3 and casing liner 4A.

Figure 4:
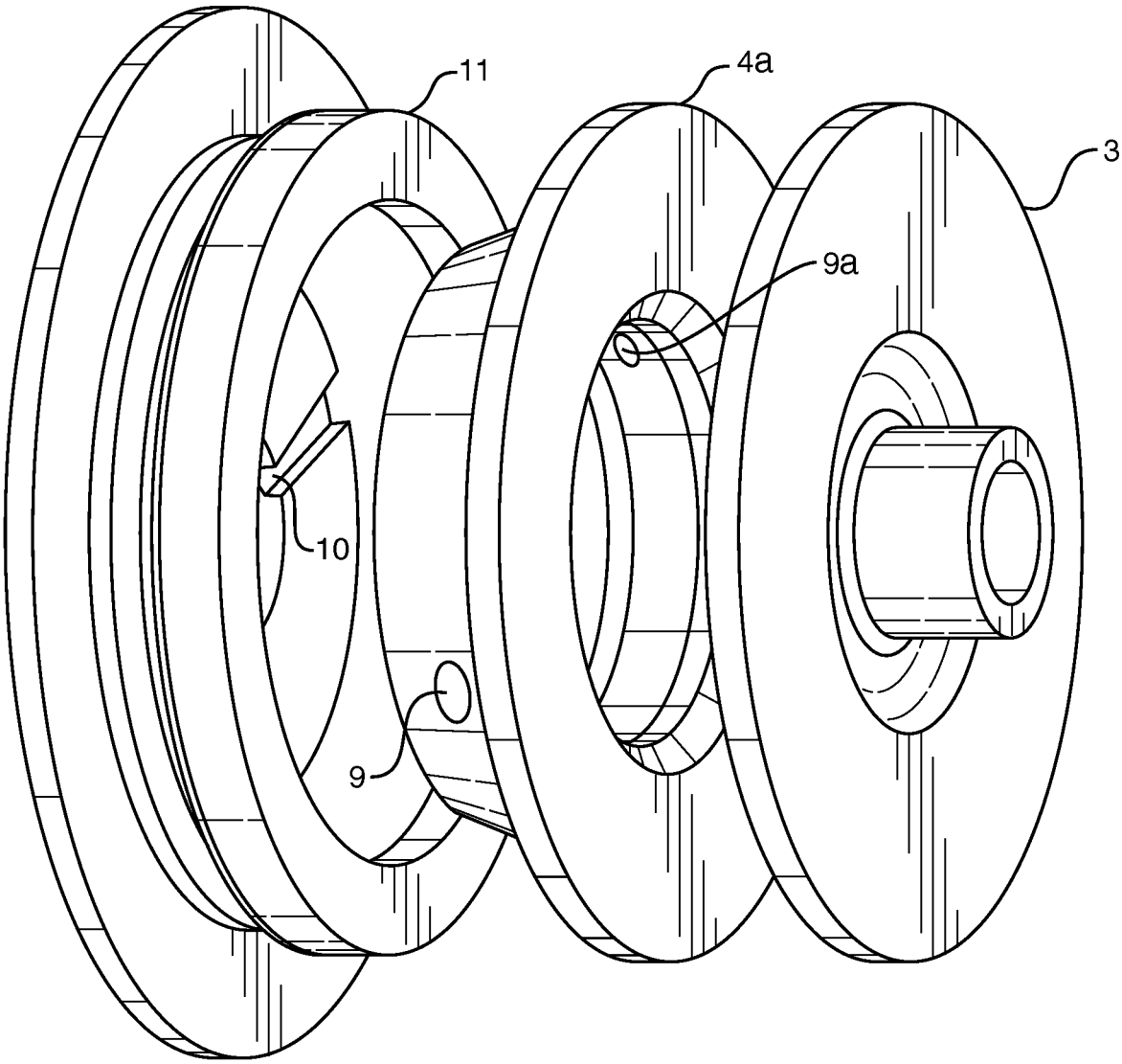
FIG. 4 is an exploded perspective view of selected elements of the embodiment of FIG. 1, illustrating relationships described herein.

The impeller 1A rotationally accelerates the process fluid to a velocity approximately equal to that of impeller 1A, the velocity of the process fluid being directly proportional to the diameter of the impeller, with the highest velocity fluid being at the outside diameter of impeller 1A. Referring to FIGS. 2 and 4, one or more nozzles 9A tangentially arranged on casing liner 4A meter the process fluid into conical diffuser 9. The flow rate of process fluid entering the impeller 1A is directly controlled by the flow rate of fluid within nozzle 9A.

Referring to FIG. 2 in particular, process fluid leaves nozzle 9A and enters conical diffuser 9 at a velocity close to the impeller rotational velocity. A controlled diffusion of the process fluid occurs between the inlet and the outlet of conical diffuser 9 due to an increase in cross-sectional area between the conical diffuser inlet and outlet that is set by design. Process fluid enters channel 10 and follows an arced path directed predominantly radially inward to annular inlet 8B where it is again accelerated by impeller 2A, repeating the process of mechanical to kinetic energy conversion described for casing liner 4A. The cross sectional area of channel 10, taken on an intersecting radial plane, is set by design so as to control head loss between stages and provide a smooth inlet flow pattern to the subsequent stage. The particular design of channel 10 will vary with the flow requirements of each pump or embodiment of the invention but the sum of the cross sectional areas of all delivery channel(s) 10 will be less than the sum of cross sectional areas of the non-channel areas within the boundaries of the channels on the intersecting radial plane.

Process fluid exiting casing liner 4B through tangential nozzle 9B enters conical diffuser 9C where it undergoes a controlled diffusion prior to entering passage 19 of discharge liner 20 to the outlet of pressure casing 13, as described above.

Leakage between the impeller chambers and the outer pressure casing chamber occurs through unsealed close fitting surfaces between casing liner 4A, 4B, channel liner 11, and discharge liner 20 to annular chamber 12. Annular chamber 12 thereby becomes pressurized. Although hydraulically pressurized, the exposed surfaces of outer pressure shell 13 and outer pressure shell cover 14 are not exposed to the high relative velocities present within the assembly of suction liner 3, casing liner 4A, channel liner 11, casing liner 4B, cover liner 5, and discharge liner 20, thereby protecting the pressure shell 13 and shell cover 14 from erosive wear.

Figure 5:
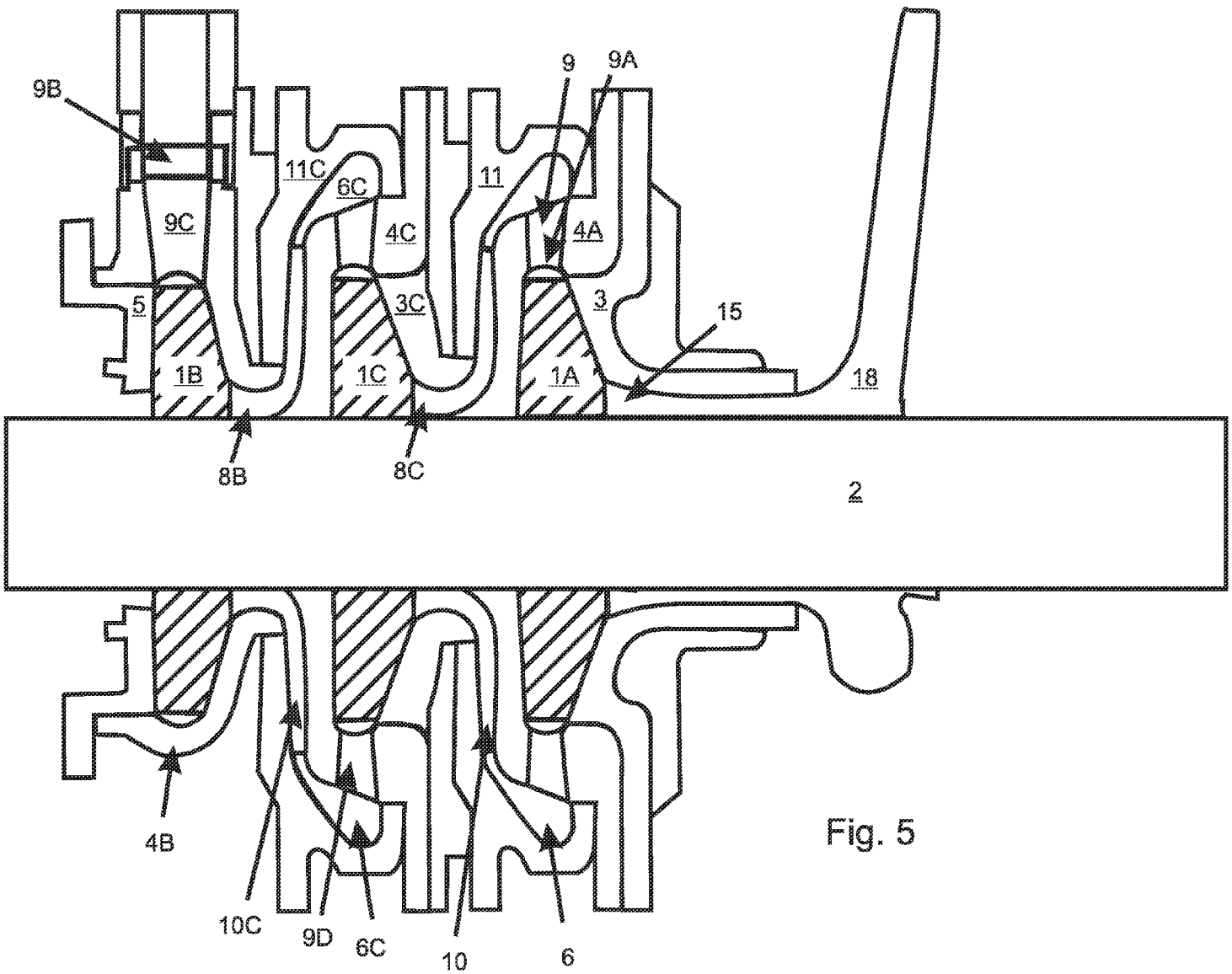
FIG. 5 shows a partial sectional view of an embodiment of a pump having three stages according to the present invention.

Referring to FIG. 5, the present invention is not limited to two impeller stages, but can be expanded to an arbitrary number of impeller stages. FIG. 5 is a partial cross-sectional illustration of an embodiment having three impeller stages. It can be seen in the figure that in this embodiment the second impeller stage is formed by repeating most of the elements surrounding the first impeller stage of FIG. 1. The item numbering in FIG. 5 is consistent with the numbering in FIG. 1, with the additional elements associated with the middle impeller stage being 1C (impeller), 3C (suction liner), 4C (casing liner), 6C (fluid channel), 8C (annular inlet), 9D (conical diffuser), 10C (delivery channel), and 11C (channel liner).

Other and various embodiments are within the scope of the invention. For example, there is a pump consisting of a first stage, first stage impeller, a final stage, a final stage impeller, a first stage casing liner, one or more first stage discharge nozzles, a final stage casing liner, one or more final stage discharge nozzles, an interstage delivery channel liner, one or more delivery channels, and a outer pressure shell. The first stage casing liner and the final stage casing liner are connected by one or more fluid channels integral within the interstage or delivery channel liner, that follow an arced path directed predominantly radially inward within the interstage delivery channel liner. The sum of the cross sectional areas of all delivery channels taken on a radial plane intersecting the delivery channels is less than the sum of cross sectional areas of the non-channel areas within the boundaries of the channels on the same plane. The surfaces of the pressure shell may be isolated from high velocity flows by the liners. The flow may be controlled by the discharge nozzles.

As another example, there is a pump consisting of a first stage, first stage impeller, one or more intermediate stage impellers, a final stage, a final stage impeller, a first stage casing liner, one or more first stage discharge nozzles, one or more intermediate stage casing liners each with one or more intermediate stage discharge nozzles, a final stage casing liner, one or more final stage discharge nozzles, a plurality of interstage delivery channel liners, each with one or more delivery channels, and an outer pressure shell. The first stage casing liner, interstage casing liners, and final stage casing liner are connected by the interstage delivery channel liners, each having one or more fluid channels that follow an arced path directed predominantly radially inward within its respective interstage delivery channel liner. The sum of the cross sectional areas of all delivery channels taken on a radial plane intersecting the delivery channels is less than the sum of cross sectional areas of the non-channel areas within the boundaries of the channels on the plane. The surfaces of the pressure shell may be isolated from high velocity flows by the liners. The flow may be controlled by the discharge nozzles.

As yet another example, there is a pump consisting of a first stage, a first stage impeller, a final stage, a final stage impeller, a first stage casing liner, one or more first stage discharge nozzles, a final stage casing liner, one or more final stage discharge nozzles, one or more delivery channels, and an outer pressure shell. The first stage casing liner and final stage casing liner are connected by one or more fluid channels integral within the assembly of the first stage casing liner with the final stage casing liner, and the fluid channels follow an arced path directed predominantly radially inward within boundaries formed by the assembly of the first stage casing liner and the final stage casing liner. The sum of the cross sectional areas of all the delivery channels taken on a radial plane intersecting the delivery channels is less than the sum of cross sectional areas of the non-channel areas within the boundaries of the delivery channels on the same plane. The surfaces of the pressure shell may be isolated from high velocity flows by the liners. The flow may be controlled by the discharge nozzles.

As still yet another example, there is a pump consisting of a first stage, a first stage impeller, one or more intermediate stages and intermediate stage impellers, a final stage, a final stage impeller, a first stage casing liner, one or more first stage discharge nozzles, one or more intermediate stage casing liners each with one or more intermediate stage discharge nozzles, a final stage casing liner, one or more final stage discharge nozzles, a plurality of interstage delivery channels, and an outer pressure shell. The first stage casing liner, interstage casing liners, and final stage casing liner are connected by one or more fluid channels that follow an arced path directed predominantly radially inward within the assembly of the adjoining casing liners. The sum of the cross sectional areas of all the delivery channels taken on a radial plane intersecting the delivery channels is less than the sum of cross sectional areas of the non-channel areas on the plane within the boundaries of the delivery channels. The surfaces of the pressure shell may be isolated from high velocity flows by the liners. The flow may be controlled by the discharge nozzles.

Other and numerous variations of the invention are within or equivalent to the scope of the claims that follow.

The invention claimed is:

1. A multi-stage partial emissions pump comprising a first stage impeller, a coaxially mounted final stage impeller, a first stage inlet liner, a first stage casing liner, one or more first stage discharge outlets, a final stage casing liner, a cover, one or more final stage discharge outlets, an interstage delivery channel liner, for each of the first stage discharge outlets an associated delivery channel formed in the interstage liner, and an outer pressure shell, wherein:

the first stage impeller is enclosed in a first stage cavity formed between the first stage inlet liner and the first stage casing liner, the first stage inlet liner being in fluid communication with a first stage inlet;

the final stage impeller is enclosed in a final stage cavity formed between the final stage casing liner and the cover, the final stage casing liner being in fluid communication with a final stage inlet;

the first and final stage discharge outlets are sized so as to restrict outflows of fluids from the first and final stage cavities during each revolution of the first and final stage impellers to be small percentages of volumes of the first and final stage cavities, respectively;

each of the first stage outlets includes a nozzle for discharging fluid into a straight conical diffuser formed in the first stage casing liner and penetrating an outer surface of the first stage casing liner;

each of the delivery channels is positioned to receive the fluid discharged from the conical diffuser of the associated first stage outlet and convey the fluid to the final stage inlet; and the sum of the cross sectional areas of all said delivery channels taken on a radial plane intersecting the delivery channels is less than the sum of cross sectional areas of all non-channel areas within all boundaries of the delivery channels on said plane.

2. The pump according to claim 1, whereby the surfaces of the pressure shell are isolated from high velocity flows by said liners.

3. A multi-stage partial emissions pump comprising a first stage impeller, one or more coaxially mounted intermediate stage impellers, a coaxially mounted final stage impeller, a first stage inlet liner, a first stage casing liner, one or more first stage discharge outlets, one or more intermediate stage inlet liners, one or more intermediate stage casing liners each with one or more intermediate stage discharge outlets, a final stage casing liner, a cover, one or more final stage discharge outlets, a plurality of interstage delivery channel liners, for each of the first stage and intermediate stage outlets an associated delivery channel formed in one of the interstage liners, and an outer pressure shell, wherein:

each of the impellers except the final stage impeller is enclosed in a cavity formed between one of the inlet liners and one of the casing liners, the inlet liner being in fluid communication with an inlet of the cavity;

the final stage impeller is enclosed in a cavity formed between the final stage casing liner and the cover, the final stage casing liner being in fluid communication with an inlet of the final stage cavity;

for each of the cavities, the discharge outlets are sized so as to restrict an outflow of fluids from the cavity to be a small percentage of a volume of the cavity during each revolution of the impeller enclosed in the cavity;

each of the discharge outlets includes a nozzle for discharging fluid into a straight conical diffuser formed in one of the casing liners and penetrating an outer surface of the casing liner;

each of the delivery channels is positioned to receive the fluid discharged from the conical diffuser of the associated discharge outlet and convey the fluid to the inlet of the next stage; and the sum of the cross sectional areas of all said delivery channels taken on a radial plane intersecting the delivery channels is less than the sum of cross sectional areas of all non-channel areas within all boundaries of the delivery channels on said plane.

4. The pump according to claim 3, whereby the surfaces of the pressure shell are isolated from high velocity flows by said liners.

5. A multi-stage partial emissions pump comprising a first stage impeller, a coaxially mounted final stage impeller, a first stage inlet liner, a first stage casing liner, one or more first stage discharge outlets, a final stage casing liner, a cover, one or more final stage discharge outlets, for each of the first stage discharge outlets an associated delivery channel formed in the final stage casing liner, and an outer pressure shell, wherein:

the first stage impeller is enclosed in a first stage cavity formed between the first stage inlet liner and the first stage casing liner, the first stage inlet liner being in fluid communication with a first stage inlet;

the final stage impeller is enclosed in a final stage cavity formed between the final stage casing liner and the cover, the final stage casing liner being in fluid communication with a final stage inlet;

the first and final stage discharge outlets are sized so as to restrict outflows of fluids from the first and final stage cavities during each revolution of the first and final stage impellers to be small percentages of volumes of the first and final stage cavities, respectively;

each of the first stage outlets includes a nozzle for discharging fluid into a straight conical diffuser formed in the first stage casing liner and penetrating an outer surface of the first stage casing liner;

each of the delivery channels is positioned to receive the fluid discharged from the conical diffuser of the associated first stage outlet and convey the fluid to the final stage inlet; and the sum of the cross sectional areas of all said delivery channels taken on a radial plane intersecting the delivery channels is less than the sum of cross sectional areas of all non-channel areas within all boundaries of the delivery channels on said plane.

6. The pump according to claim 5, whereby the surfaces of the pressure shell are isolated from high velocity flows by said liners.

7. A multi-stage partial emissions pump comprising a first stage impeller, one or more coaxially mounted intermediate stage impellers, a coaxially mounted final stage impeller, a first stage inlet liner, a first stage casing liner, one or more first stage discharge outlets, one or more intermediate stage inlet liners, one or more intermediate stage casing liners each with one or more intermediate stage discharge outlets, a final stage casing liner, a cover, one or more final stage discharge outlets, for each of the first stage and intermediate stage outlets an associated delivery channel formed in one of the inlet liners, and an outer pressure shell, wherein each of the impellers except the final stage impeller is enclosed in a cavity formed between one of the inlet liners and one of the casing liners, the inlet liner being in fluid communication with an inlet of the cavity;

the final stage impeller is enclosed in a cavity formed between the final stage casing liner and the cover, the final stage casing liner being in fluid communication with an inlet of the final stage cavity;

for each of the cavities, the discharge outlets are sized so as to restrict an outflow of fluids from the cavity to be a small percentage of a volume of the cavity during each revolution of the impeller enclosed in the cavity;

each of the discharge outlets includes a nozzle for discharging fluid into a straight conical diffuser formed in one of the casing liners and penetrating an outer surface of the casing liner;

each of the delivery channels is positioned to receive the fluid discharged from the conical diffuser of the associated discharge outlet and convey the fluid to the inlet of the next stage; and the sum of the cross sectional areas of all said delivery channels taken on a radial plane intersecting the delivery channels is less than the sum of cross sectional areas of all non-channel areas on said plane within all boundaries of said delivery channels.

8. The pump according to claim 7, whereby the surfaces of the pressure shell are isolated from high velocity flows by said liners.

* * * * *